US007442019B2

(12) United States Patent
Kaiser et al.

(10) Patent No.: US 7,442,019 B2
(45) Date of Patent: Oct. 28, 2008

(54) STATOR OF A MOINEAU-PUMP

(75) Inventors: Trent Michael Victor Kaiser, Edmonton (CA); Maurice William Slack, Edmonton (CA); Daniel Dall'Acqua, Edmonton (CA)

(73) Assignee: Noetic Engineering Inc., Edmonton (CA)

( * ) Notice: Subject to any disclaimer, the term of this patent is extended or adjusted under 35 U.S.C. 154(b) by 159 days.

(21) Appl. No.: 10/532,442

(22) PCT Filed: Oct. 21, 2003

(86) PCT No.: PCT/CA03/01607

§ 371 (c)(1),
(2), (4) Date: Apr. 21, 2005

(87) PCT Pub. No.: WO2004/036043

PCT Pub. Date: Apr. 29, 2004

(65) Prior Publication Data

US 2006/0029507 A1 Feb. 9, 2006

(30) Foreign Application Priority Data

Oct. 21, 2002 (CA) ..... 2409054
Nov. 19, 2002 (CA) ..... 2412209

(51) Int. Cl.
*F01C 5/02* (2006.01)
*F01C 1/10* (2006.01)

(52) U.S. Cl. ..... 418/153; 418/48; 418/152; 418/178

(58) Field of Classification Search ..... 418/148, 418/152, 153, 178, 48
See application file for complete search history.

(56) References Cited

U.S. PATENT DOCUMENTS

| | | | | |
|---|---|---|---|---|
| 2,695,565 | A * | 11/1954 | Seinfeld | 418/48 |
| 3,139,035 | A * | 6/1964 | O'Connor | 418/1 |
| 3,499,389 | A * | 3/1970 | Seeberger et al. | 418/48 |
| 5,171,138 | A * | 12/1992 | Forrest | 418/48 |
| 5,927,120 | A * | 7/1999 | Marando | 72/61 |
| 6,293,358 | B1 * | 9/2001 | Jager | 175/107 |
| 6,309,195 | B1 * | 10/2001 | Bottos et al. | 418/48 |
| 6,336,796 | B1 | 1/2002 | Cholet et al. | |
| 6,409,226 | B1 | 6/2002 | Slack et al. | |
| 6,427,787 | B1 | 8/2002 | Jager | |
| 6,457,958 | B1 * | 10/2002 | Dunn | 418/48 |
| 6,497,030 | B1 * | 12/2002 | Marando | 29/421.1 |
| 6,543,132 | B1 * | 4/2003 | Krueger et al. | 29/888.023 |

(Continued)

FOREIGN PATENT DOCUMENTS

CA 2 315 043 A1 6/1999

(Continued)

OTHER PUBLICATIONS

E.L. Bird and G.M. Ludtka, Hydroforming Applications at Oak Ridge, Mar. 15, 1999; For Presentation at the Society of Manufacturing Engineers, Mar. 1999.*

*Primary Examiner*—Thomas Denion
*Assistant Examiner*—Mary A Davis
(74) *Attorney, Agent, or Firm*—Christensen O'Connor Johnson Kindness PLLC

(57) ABSTRACT

A Moineau stator includes a tube (10) having lobes (3) arranged in a configuration which is adapted to interact with a rotor and formed through a hydroforming process.

3 Claims, 6 Drawing Sheets

U.S. PATENT DOCUMENTS

| | | | | |
|---|---|---|---|---|
| 6,604,922 | B1 * | 7/2003 | Plop et al. | 418/48 |
| 2003/0192184 | A1 * | 10/2003 | Hache | 29/888.02 |
| 2004/0258548 | A1 * | 12/2004 | Zitka et al. | 418/48 |

FOREIGN PATENT DOCUMENTS

| | | | |
|---|---|---|---|
| CA | 2 333 948 | A1 | 12/1999 |
| DE | 3 119 568 | A1 | 12/1982 |
| EP | 0 459 740 | A1 | 4/1991 |
| FR | 2 826 407 | | 12/2002 |

* cited by examiner

STATOR OF A MOINEAU-PUMP

FIELD OF THE INVENTION

The present invention relates to a method of forming a Moineau Stator and a Moineau Stator formed in accordance with the teachings of the method.

BACKGROUND OF THE INVENTION

PC pumps and mud motors ("Moineau pumps") of conventional design have a moulded elastomeric insert bonded firmly to the inside of a cylindrical case, usually made of steel. This comprises the stator of the pump or motor unit. The inside shape of the elastomer is formed with a cavity that has a helical characteristic that mates with a helically-shaped stator. Interference between the two components creates seal lines that contain cavities of fluid which progress in the axial direction when the rotor is rotated relative to the stator. If rotational power is applied to the rotor, the assembly functions as a pump against differential pressure. If differential pressure is applied across the assembly, rotary power is extracted from the rotor and the assembly functions as a motor.

When formed inside of a cylindrical case out of elastomer, the shape of the stator cavity requires the elastomer thickness to vary around the circumference. The locations where the thickness is greatest are subjected to the largest distortional elastomer stresses during operation.

Cyclic stress developed in the elastomer by the seal location moving back and forth, or around the stator cavity generates heat in the core of the elastomer, which must be removed by conduction through the elastomer, either to the outer stator casing or to the inner surface of the elastomer where it is convected to the transported fluid. In conventional designs, the largest heat-generation rate occurs where the ability to remove the heat is lowest. If it over-heats, the elastomer can fail and the function of the pump/motor is compromised. This has been a significant limitation in the performance and design of progressing cavity pumps and motors, and has led to the development of "uniform-thickness" elastomer designs, where the internal casing profile is provided to closely match the required stator cavity profile, and a relatively thin layer of elastomer is moulded to this surface to provide the final stator cavity geometry.

This approach has several advantages, including reduced heat generation and swelling characteristics. The primary disadvantage is the cost of providing the relatively complicated internal profile from the high-strength material of the casing. Several approaches have been developed, including cold-rolling techniques, machining of the internal profile, and the use of extrusion techniques to produce the required geometry. These approaches are expensive, particularly in the lengths required for PC pump/motor applications. Some of these techniques are described in Canadian Patents 2,315,043 (Krueger et al), 2,333,948 (Underwood et al) and U.S. Pat. No. 6,427,787.

Furthermore, while these patents identify certain advantages to be gained from thin walled stators, the methods of manufacture described, are not amenable to close tolerance control for such stators.

SUMMARY OF THE INVENTION

What is required is an alternative method of forming a profiled Moineau stator, where such method supports the forming of a thin walled profiled Moineau stator.

According to the present invention there is provided a method of forming a Moineau stator with a prescribed interior profile. A first step involves placing a ductile metal tube into a hydroforming fixture. A second step involves forming the tube to have lobes through a hydroforming process. The lobes are arranged in a configuration which is adapted to interact with a rotor.

In order to ensure efficient fluid movement, it is preferred that a further step be taken of coating the interior of the tube with an elastomer layer adapted to form a fluid seal with a rotor. As will hereinafter be described, hydroforming is a very cost effective alternative to previously known methods of forming profiled Moineau stator cases suitable for lining with a uniform thickness elastomeric layer. Although using this method, the elastomer coating on the interior of the tube need not be uniform.

According to another aspect of the present invention there is provided a Moineau stator which includes a tube having lobes arranged in a configuration which is adapted to interact with a rotor and formed through a hydroforming process. It is preferred that the tube has an elastomer coated interior adapted to form a liquid seal with a rotor. This elastomer coating may be of uniform thickness or may intentionally be made unequal to create a preferential distribution of elastomer coating at intervals along the axial length of the tube.

The beneficial results obtained through the use of the Moineau stator, as described above, may be further distinguished as this method can be used with both thick walled and thin walled embodiments. The greater rigidity and strength of thick walled embodiments supports containment of greater pressure differential than thin walled embodiments, while thin walled embodiments enjoy the benefit of reacting a significant portion of the seal interference through non-heat generating deformation of the tube wall rather than mostly as heat generating elastomer deformation.

It is therefore preferred that thin walled embodiments be surrounded by a coaxially positioned support housing capable of reacting the majority of the total pump or motor pressure differential. This support housing can either be cylindrical or may have lobes, at least on its interior surface, where said interior lobes are arranged as if comprising an additional external stator in relation to the lobed stator exterior as if acting as a rotor. Means to transfer radial load from the exterior of the thin walled stator to the interior of the support housing is provided largely by material placed in the annular space between the stator and support housing arranged to limit the pressure differential across the thin walled stator to prevent its excess expansion or collapse. The material placed in the annular space is preferably a fluid with means to control its pressure. The annular space is more preferably arranged to allow for a variation of the annular fluid pressure along the stator length to generally equalize the pressure between the annulus and stator interior. Variation of the annular fluid pressure is supported by providing a plurality of generally axially distributed discrete cavities, sealing segregated from each other.

When the support housing has internal lobes arranged in relation to the thin walled stator as described above, it will be appreciated that a plurality of generally axially distributed cavities is formed. In such case it is preferred that the tube have an exterior surface coated with elastomer to more readily sealingly engage the interior surface of the lobed support housing and thus provide a more positive fluid seal between adjacent cavities.

When the support housing is provided as a cylinder, one or more axially distributed bulkheads are placed in the annulus between the tube and the support housing. Said bulkheads and arranged to attach to at least one of and sealingly engage both the tube and support housing thus creating axially distributed discrete cavities.

There are various means which can be used to equalize pressure between the cavities thus formed and the stator interior. There will hereinafter be illustrated and described a method which involves providing fluid passages which allow fluids from the interior of the tube to communicate with the axial cavities.

BRIEF DESCRIPTION OF THE DRAWINGS

These and other features of the invention will become more apparent from the following description in which reference is made to the appended drawings, the drawings are for the purpose of illustration only and are not intended to in any way limit the scope of the invention to the particular embodiment or embodiments shown, wherein.

DETAILED DESCRIPTION OF THE PREFERRED EMBODIMENT

Figure 1:
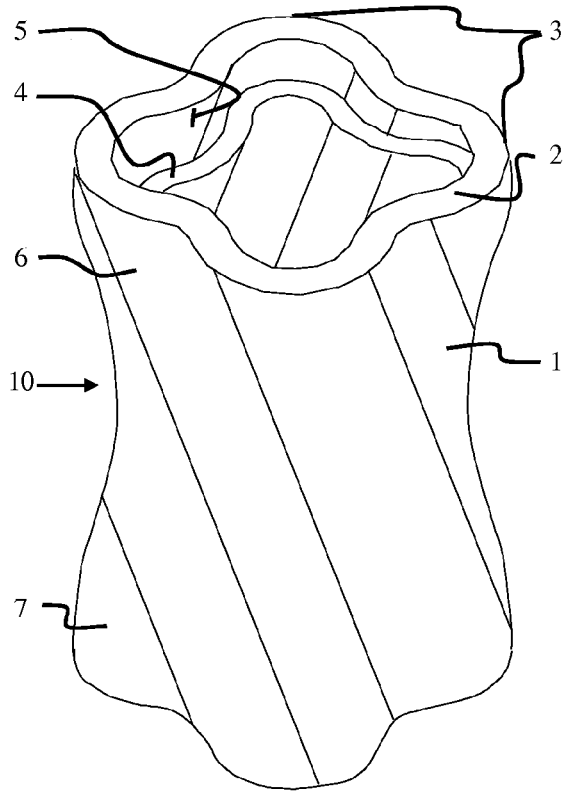
FIG. 1 is a perspective view of the uniform thickness Moineau stator fabricated in accordance with the teachings of the present invention.

The preferred embodiment, a uniform elastomer thickness Moineau stator generally identified by reference numeral 10, will now be described with reference to FIGS. 1 through 10.

Referring now to FIG. 1, a stator 10 is shown comprised of a stator body 1 formed from a metal tube having a sidewall 2 into which a plurality of helically symmetric lobes 3 are placed, illustrated here as it would appear configured in a four lobe Moineau stator. An elastomeric liner 4 is disposed on the inside surface 5 of the stator body 1. The lobes are placed by a specialized stator hydroforming process.

Hydroforming is a manufacturing method that generally uses fluid pressure to deform a ductile metal shell against a mold. To form shapes such as required for stators 10, the mold can take a number of helical and solid forms, configured so that the post-hydroformed internal profile of the stator housing obtains the general form of the lobed profile of the inner surface of the elastomer. If necessary, the part may be heat treated after forming to relieve residual stresses, provided this process does not change the dimensional tolerances so the part is unusable. The desired stator profile may be achieved by hydroforming using either internal or external pressure to deform the tube.

Figure 2:
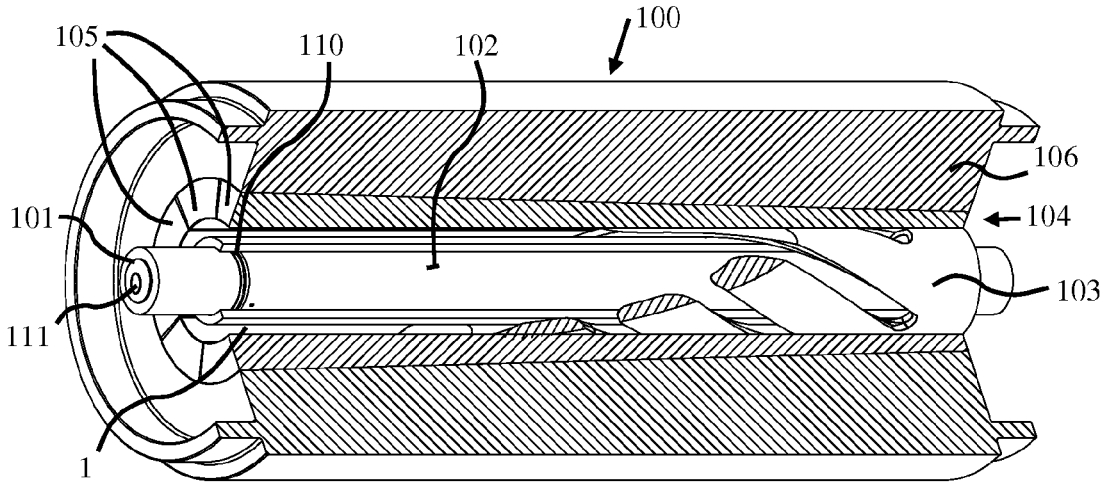
FIG. 2 is a perspective cut-away view of a stator hydroforming fixture constructed in accordance with the teachings of the present invention.

Referring now to FIG. 2, in its preferred embodiment a hydroforming fixture 100 is provided to implement said preferred stator hydroforming process by application of internal pressure. The fixture is essentially a coaxial assembly of close fitting largely cylindrical components. Beginning with the innermost and progressing outward, these components are: a mandrel 101, stator body 1 as a work piece (provided as a metal tubular 'blank'), a mold assembly 103 comprised of elements as necessary to allow removal after forming, an externally tapered collet 104 comprised of an assembly of jaws 105 and a confining vessel or bell 106 a thick-walled pressure vessel capable of containing the forming pressure and internally tapered to mate with the collet. Additionally, a means to apply axial displacement between the collet 104 and bell 106 is provided, such as a double acting hydraulic actuator (not shown). As will be apparent to one skilled in the art said axial displacement is converted to radial displacement by the collet jaws 105 moving in contact with the bell 106 facilitating installation and removal of the close fitting parts.

Figure 3:
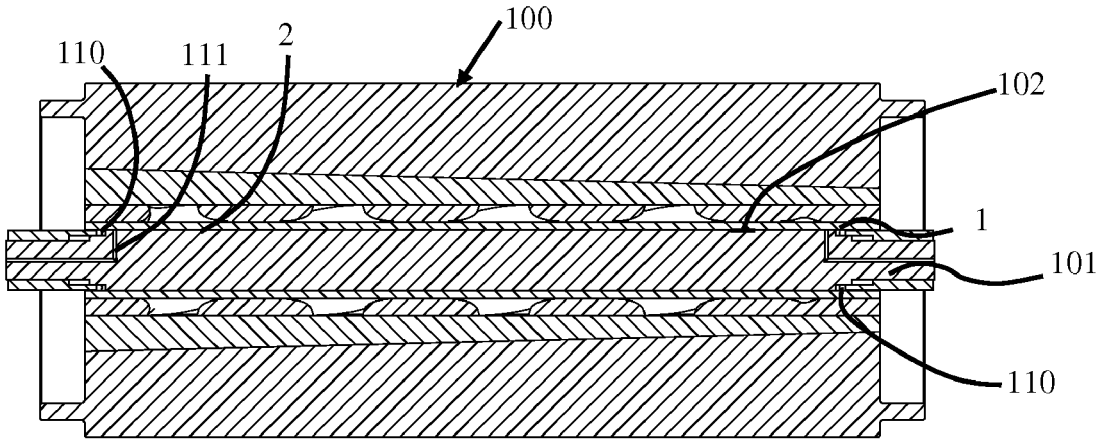
FIG. 3 is a side elevation view, in section, of the stator hydroforming fixture illustrated in FIG. 2 with tube inserted ready for forming.

Referring now to FIG. 3, the mandrel 101 is provided with internal seals 110 engaging the inside bore 2 of the work piece blank 1 and a fluid entry port 111 in communication with the mandrel exterior 102 between the seals 110. Fluid applied through this port is thus contained by the mandrel 101, it being in sealing engagement with the work piece 1, allowing application of pressure to the internal surface of the workpiece 1 by suitable means such as may be provided by a high pressure air over hydraulic pump.

Figure 4:
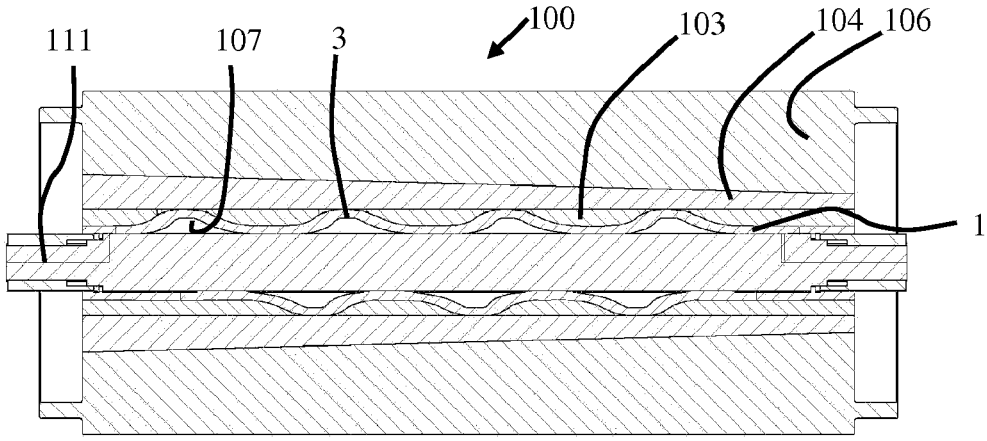
FIG. 4 is a side elevation view, in section, of the stator hydroforming fixture illustrated in FIG. 2 with tube after the forming process has been concluded.

Referring now to FIG. 4, application of sufficient pressure through port 111 causes the work piece 1 to expand and plastically deform unless constrained by contact with the internal surface of the contained mold, thus inflating the sidewall of the work piece 1 into the mold cavities 107 to form lobes 3 in the stator body 1. The portion of the pressure force reacted by the mold 103 is in turn reacted through the collet 104 into the bell 106. Due to the tapered interface between the collet 104 and bell 106, the collet 104 may tend to slip in the bell 106 while under pressure load allowing unwanted expansion of the work piece 1. This movement may be readily prevented by application of axial load or other suitable means of restraint between the collet jaws 105 and bell 106. Upon removal of the forming pressure, the mandrel 101 is readily removed, however a residual radial stress or interference may exist between the work piece 1 and mold assembly 103 tending to resist removal of the work piece 1 and mold assembly 103 from the collet 104. This radial stress is relieved by appropriate displacement of the collet relative to the bell enabling removal of the work piece 1 together with the components of the mold assembly 103, since the formed lobes 3 are interlocking with the mold cavities 107 after forming. Once removed from the forming fixture 100 the mold assembly 103 may be removed from the formed stator body 1.

The hydroforming fixture 100 is preferably long enough to ensure that the profiled stator 10 can be formed as a single piece. Alternately, the stator may be formed in short lengths and assembled into a complete unit, with the length depending on the required pressure capacity of the pump or motor. If necessary, the forming process on any one piece could be performed in more than one step (i.e., multiple hydroforming steps using different die sets) to ensure that a preferential distribution of plastic strain is achieved in the housing.

With reference now to FIG. 1, it will be appreciated that further finishing of the ends 6 & 7 of the stator body 1, hydroformed according to the teachings of the present invention, will generally be required to enable attachment of the stator 10 to other elements of the pump or motor, or drill string or tubing string supporting said pump or motor. The end geometries must accommodate insertion of the rump or motor rotor and any other components that must pass through the stator. The correct geometry may either be incorporated into the hydroforming design or could be fitted after forming is complete. In one embodiment, during hydroforming, the end sections of the stator tube 6 & 7 are held at the initial (unformed) diameter to enable sealing with the mandrel 101. After the formed tube is removed from the fixture, these ends are cut off. Required connections to other components of the string can be achieved through welding or other means.

The inner elastomer layer 4 may be applied to the stator body 1 by various means known to the industry but is preferably placed by injection moulding. Referring again to FIG. 4, the hydroforming fixture 100 supports this operation which may require internal pressure greater than can be born by the unsupported stator body 1. To complete this task, a mandrel defining the inner profile of the elastomer is centralized inside the formed tube, and the elastomer injected according to standard injection moulding practice.

Figure 5:
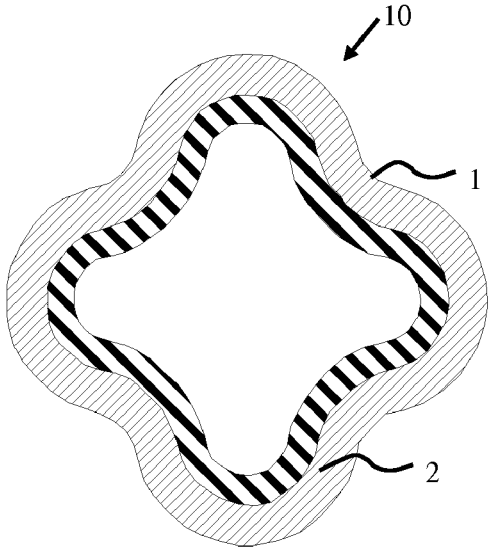
FIG. 5 is a cross-sectional view of a uniform thickness Moineau stator with thick walls fabricated in accordance with the teachings of the present invention.

According to the needs of various applications, the hydroformed stator body 1 may be manufactured in both thin-wall and thick-wall configurations as understood in the art. Referring now to FIG. 5, in thick-wall implementations the thickness of the hydroformed stator body 1 sidewall 2 is selected so that it is substantially rigid under application of rotor contact loads and preferably has sufficient strength to react the pressure differential that may arise in use of the stator 10 in a pump or motor. As shown in the cross section view of FIG. 5, the external profile of the hydroformed thick wall stator body 1 generally has the same character as its internal profile. This is typically the most space-efficient design, and the external profile offers several advantages in use, including reduced flow loss through the external annulus formed when the stator is placed within a well, and added flexibility for installation options. In this case, the thickness of the stator body 1 must be adequate to support the torsional and axial loads generated during operation in addition to the associated internal fluid pressure.

Figure 6:
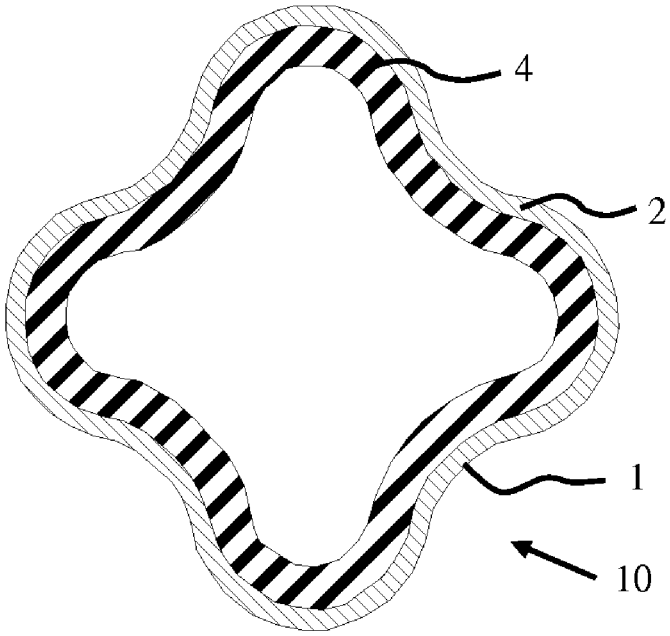
FIG. 6 is a cross-sectional view of a uniform thickness Moineau stator with thin walls fabricated in accordance with the teachings of the present invention.

Referring now to FIG. 6, a hydroformed stator 10 is shown in cross section as it would appear in its thin wall configuration. (Thick and thin wall representations between FIGS. 5 and 6 are only intended to illustrate relative proportions of the stator body 1.) In this configuration, the thickness of the stator body 1 sidewall 2 is selected so that it will deflect under application of the rotor interference load, thus contributing a portion of the compliance required to accommodate the interference effecting the seal contact stress. This is advantageous as a means to reduce the demands placed on the elastomer layer 4, however it simultaneously reduces the pressure capacity of the stator body 1.

Figure 7:
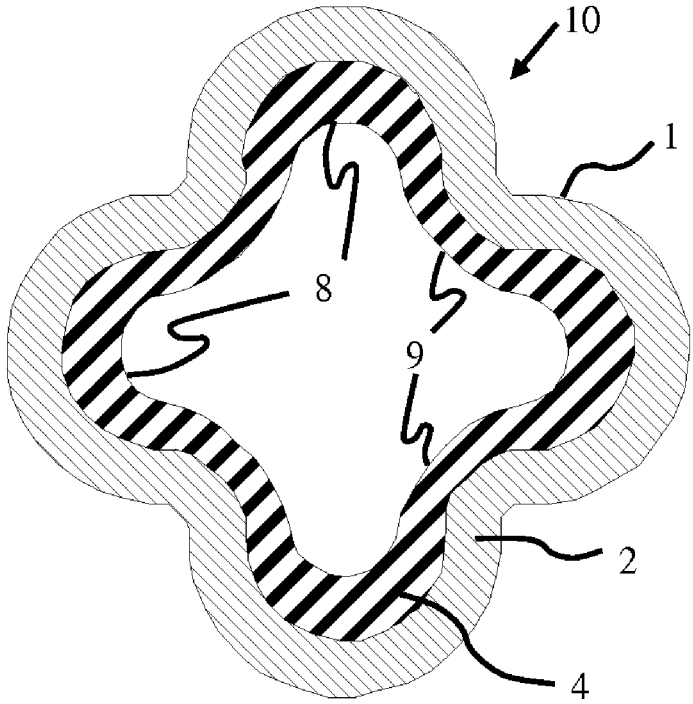
FIG. 7 is a cross-sectional view of a variable elastomer thickness Moineau stator with thick walls fabricated in accordance with the teachings of the present invention.

In addition to the benefits obtained from an elastomer of uniform wall thickness, additional benefits may be obtained where the elastomer thickness is selected to vary such that the performance characteristics of the motor or pump (fluid seal quality and consistency, heat generation and dissipation in the elastomer, elastomer/housing bond performance) are optimized. Referring now to FIG. 7, the elastomer 4 is shown to have a variable circumferential thickness, with the thickness being larger at the major seal locations 8 and smaller at the minor seal locations 9. In an application that is particularly sensitive to heat generation, the elastomer thickness at the major seal could be selected to be greater than that at the minor seal. This would make the major seal more compliant than if the elastomer thicknesses were consistent and would reduce the sensitivity of the heat generation rate to rotor and/or stator dimensional tolerance variations. As will be apparent to one skilled in the art, other optimizations pertaining to performance could be achieved by varying the circumferential and/or axial distribution of elastomer thickness. The hydroforming fixture 100 readily supports such control of elastomer thickness distribution, by modifying the geometry of mold assembly 103 in coordination with selection of the internal pressure.

Figure 8:
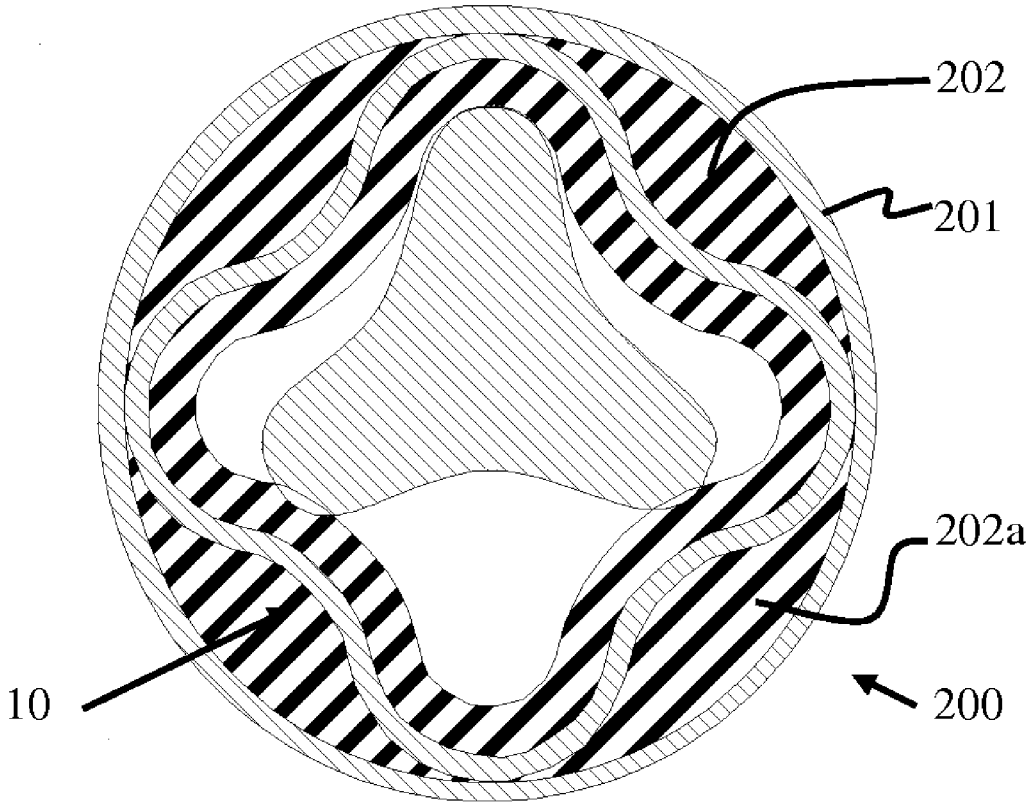
FIG. 8 is a cross-sectional view of the uniform thickness Moineau stator with thin walls illustrated in FIG. 6, with a cylindrical support housing.

In applications where such reduced pressure capacity is insufficient, the stator 10 is preferably supported by a secondary containment vessel. In one embodiment, the secondary containment vessel is provided as a cylinder. Referring now to FIG. 8, in this embodiment, a supported thin wall stator assembly 200 is shown in cross section where, the thin walled stator body 1 is coaxially placed inside a cylindrical support housing 201 forming an internal annulus 202. With this configuration, the stator body 1 is readily supported as required by a filler to prevent its excess expansion or collapse by providing means to transfer radial load across the annulus 202. Such filler may be provided by placing a compliant but relatively incompressible solid such as an elastomer in the annulus 202. Alternately radial load transfer is readily provided by fluid pressure in the annulus 202 where, in a manner know to the art, end closures are provided to sealingly attach the ends of stator body 1 to the cylindrical support housing 201 and the annulus 202 allowed to communicate with various of the fluid pressure points in the pump or motor application.

However, the fluid pressure is more preferably arranged to vary along the length of the stator 10 to generally equalize the pressure between the annulus and stator interior. It will be appreciated that control of pressure in these annulus cavities provides a means to reduce the pressure drop across the stator 10 and thus prevent overload of the stator body 1.

Figure 9:
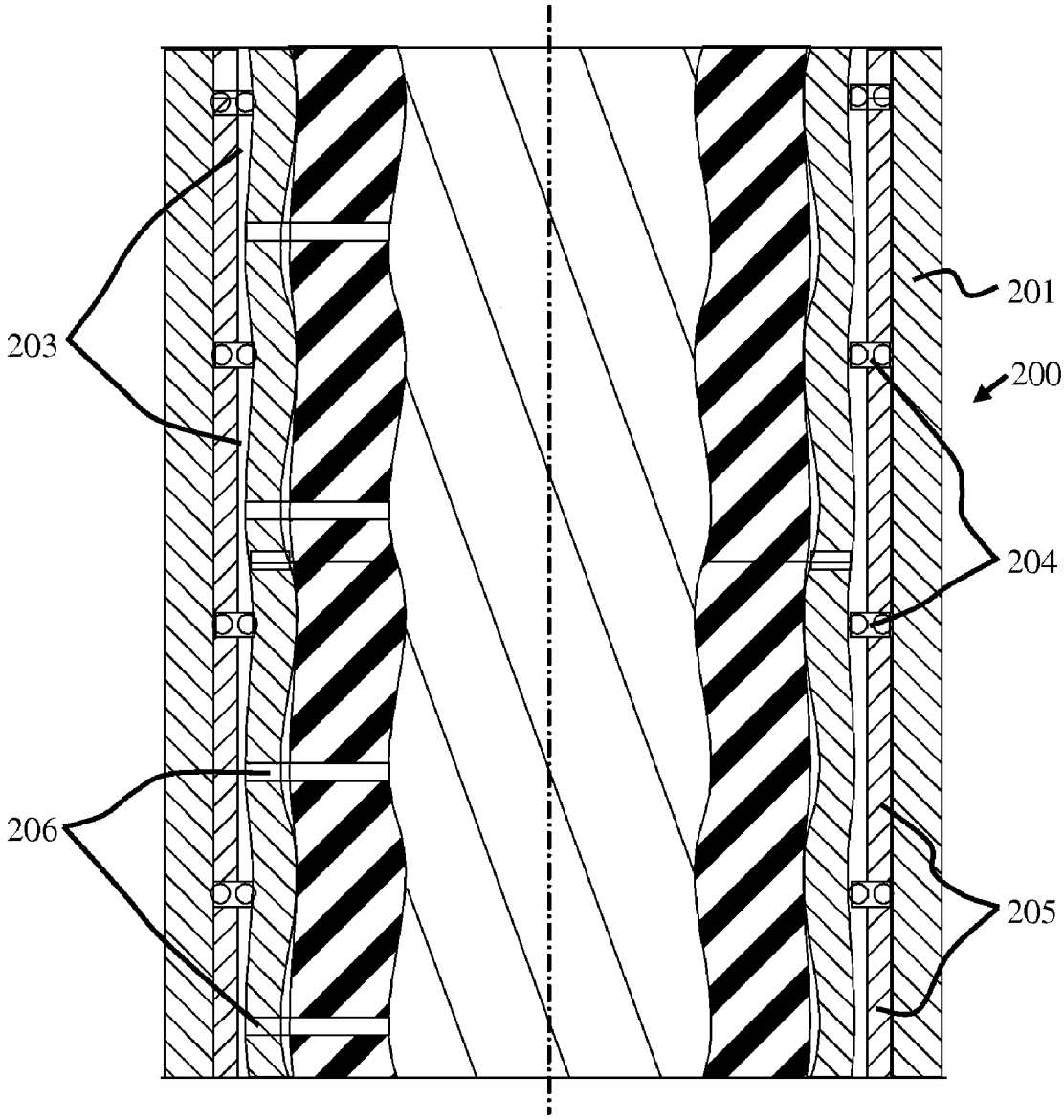
FIG. 9 is a side elevation view, in section, of the uniform thickness Moineau stator with thin walls illustrated in FIG. 6, with a cylindrical support housing and discrete pressurized axial cavities.

One novel means to provide such graduated pressure support is described now with reference to FIG. 9 showing an interval of a supported thin walled stator assembly 200. Variation of the annular fluid pressure is supported by providing a plurality of generally axially distributed discrete cavities 203, sealing segregated from each other by bulkheads 204. The position of bulkheads 204 is maintained by spacers 205 contained within the support housing 201 and associated end closures. This configuration also provides a simple means of achieving accurate seal element spacing. Pressure equalization is provided by ports 206.

Figure 10:
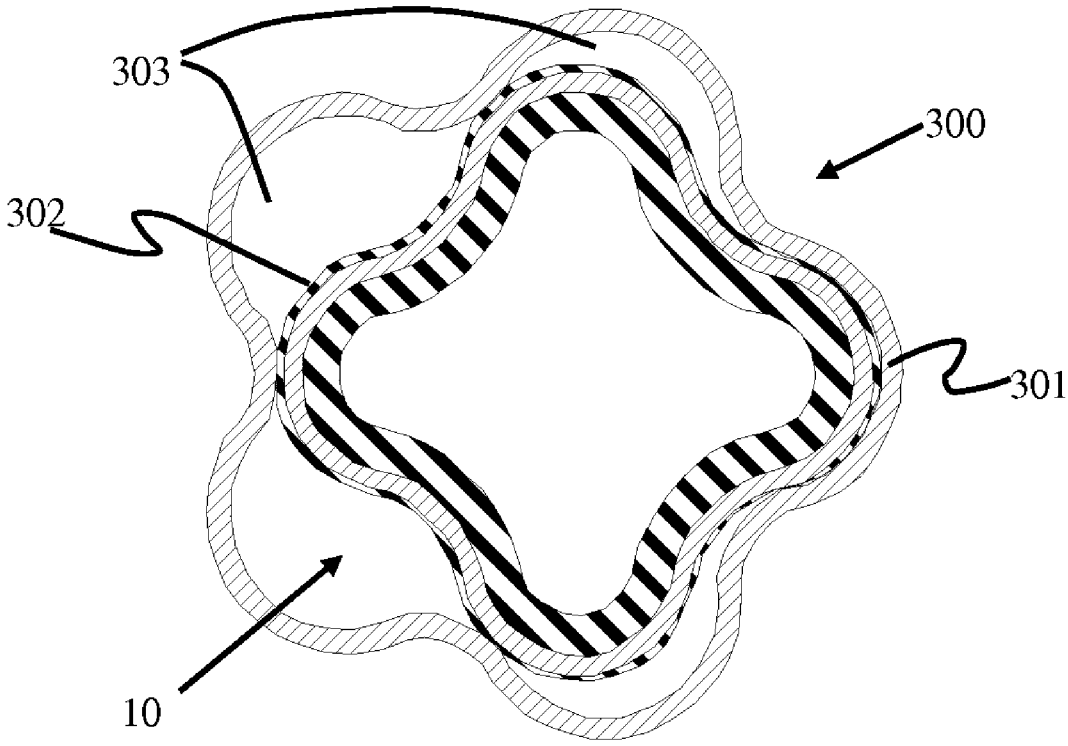
FIG. 10 is a cross-section view of the uniform thickness Moineau stator with thin walls illustrated in FIG. 6, disposed within a multi-lobed support housing.

Referring now to FIG. 10, in an alternate even more novel embodiment, a supported thin wall stator assembly 300 is shown in cross section where graduated pressure support is enabled by providing the support with a lobed support housing 301 configured in a hypocycloid geometry compatible with the stator 10 so that the stator 10 can be easily inserted into the lobed support housing. In this case, the lobed support housing 301 has one more lobe than the primary housing and a pitch defined by the ratio of secondary to primary hypocycloid lobes. Seals between cavities are generated either through metal-to-metal seals or (more likely) through contact with an intermediate elastomer layer 302 applied to the outside of the stator 10 or inside of the lobed support housing 301. The cavities 303 are ported to the transported fluid to provide pressure equalization as required to prevent excess deformation of the stator 10. The cavities that terminate at either end of the motor section may be sealed to reduce risk of fluid migration along the cavities.

By providing a thin-walled stator 10 with a secondary housing, the stator housing geometry will be less expensive to fabricate than a single thick-walled primary housing. Using a formed secondary housing could simplify the task of creating an axial pressure distribution in the stator housing annulus provided the overall size of the motor is not prohibitive. Both of these approaches would provide additional compliance at the rotor/stator seal lines to accommodate tolerances, swelling and thermal expansion. This is a significant advantage over conventional uniform-wall designs, where the stiffness of the thin elastomer layer has low tolerance for such variations. Indeed, careful design of the thin-wall stator could reduce the required elastomer thickness or eliminate the requirement for an elastomer completely in many applications.

Another embodiment of this essential theme is a thin-walled design with a supporting structure provided by a high-strength composite wrap that can carry the full differential pressure between the transported fluid and the surrounding fluid. The thickness of this wrap might vary over the pump/motor length consistent with the variation in differential pressure over the length.

The invention claimed is:

1. A Moineau stator, comprising:

a tube (10) having lobes (3) arranged in a configuration which is adapted to interact with a rotor, the tube (10) is thin-walled with walls (2) that are sufficiently thin as to be subjected to elastic deformation in response to interfacial seal forces imposed by interference with the rotor and is surrounded by a supporting structure (201) in the form of a support housing having walls able to resist pressure, torque, and axial loads experienced in its intended operating environment, discrete pressurized axial cavities (203) are positioned in an annulus (202) between the tube (10) and the support housing (201) and fluid passages (206) are provided to equalize pressure in the axial cavities (203) with pressure within the interior (5) of the tube (10) by allowing fluids from the interior (5) of the tube (10) to communicate with the axial cavities (203).

2. The Moineau stator as defined in claim 1, wherein the support housing (301) has lobes arranged in a configuration adapted to interact with the lobes on the tube (10) to form said discrete pressurized axial cavities, thereby balancing pressure acting on the interior surface (5) of the tube (10) with a substantially equal pressure acting on the exterior surface (6) of the tube (10) such that the deformation of the tube (10) in response to pressure variations is limited.

3. The Moineau stator as defined in claim 2, wherein one of an exterior surface (6) of the tube (10) or an interior surface of the support housing (301) is coated with elastomer (302).

* * * * *